United States Patent [19]

Cristina

[11] 4,301,712

[45] Nov. 24, 1981

[54] DEVICE FOR CONTROLLING THE DEGREE OF BLOWBACK DELAY IN AUTOMATIC WEAPONS

[76] Inventor: Salvatore J. Cristina, 3555 Olinville Ave., Bronx, N.Y. 10467

[21] Appl. No.: 36,405

[22] Filed: May 7, 1979

[51] Int. Cl.[3] ..... F41D 11/06

[52] U.S. Cl. ..... 89/153; 89/190

[58] Field of Search ..... 89/151, 152, 153, 180, 89/190

[56] References Cited

U.S. PATENT DOCUMENTS 691,040 1/1902 Young ..... 89/153
908,631 1/1909 Warnant-Creon ..... 89/153
1,052,394 2/1913 White ..... 89/153
2,365,389 12/1944 Browning ..... 89/190

*Primary Examiner*—Stephen C. Bentley
*Attorney, Agent, or Firm*—James J. Romano, Jr.

[57] ABSTRACT

Device for controlling the degree of blowback delay in automatically operable weapons is provided and comprises locking means which are operable to prevent opening of the weapon breech until breech pressures have dropped to generally residual, safe levels. For use with automatically operable pistols the device takes the form of a hammerlock which locks the hammer to the slide, and for use with automatically operable long guns the device takes the form of a boltlock which locks the bolt to the receiver.

3 Claims, 9 Drawing Figures

DEVICE FOR CONTROLLING THE DEGREE OF BLOWBACK DELAY IN AUTOMATIC WEAPONS

BACKGROUND OF THE INVENTION

1. Field of the Invention

This invention relates to a new and improved device for the controlled delay of blowback in high-powered, semi-automatic and/or fully automatic (hereinafter more simply "automatic") weapons, which is particularly though not exclusively adapted for use in high-powered automatic pistols.

2. Description of the Prior Art

Although high-powered automatic pistols are, of course, well known in the prior art, it may be understood that the high pressures, and accordingly recoil forces, generated attendant the firing thereof have heretofore generally rendered impractical the operation thereof with delayed blowback actions, and have required instead relatively complex actions in the nature of the locked breech, short recoil operated action utilized, for example, in the 0.45 calibre Colt Govt. Model 1911A1 automatic pistol wherein a moveable barrel pivotally supported by a "Browning" link for rearward and downward barrel movement is required to assist in the absorbance of the substantial recoil forces generated attendant firing. The significant disadvantages of this type of action include: high cost of manufacture due to complexity of the action which requires an excessive number of parts; less than optimal accuracy due to variations in point of aim attendant necessary barrel looseness; less than optimal strength due to the fact that the barrel is not fastened to the receiver; relatively high maintenance requirements due to wear of moving parts; less than optimal reliability of cartridge feeding action due to relatively long distance between barrel breech and magazine and greater possibility of barrel breech-magazine misalignment; and less than optimal reliability of spent cartridge ejection action due to greater possibility of barrel breech-slide misalignment. Another example of a relatively complex, expensive, and not optimally accurate or reliable type of locked breech, short recoil operated action is that found in the toggle-joint breech Luger pistol. Too, although a few high-powered automatic pistols are known, as for example the MAB P.15 Standard and the old Steyer-Hahn, which incorporate delayed blowback types of actions, the same will also be seen to be of relatively complex, expensive and not optimally accurate or reliable construction in again requiring a moveably mounted barrel which rotates upon firing for purposes of unlocking barrel locking lugs from a slide locking shoulder.

With regard to high-powered automatic rifles and the like, the vast majority of which, of course, utilize gas-operated long or short recoil mechanisms, it is believed that the not insubstantial complexity, expense and high-maintenance requirements of those mechanisms are too well known to those skilled in this art to warrant elaborate discussion herein.

In addition to the above, no high-powered automatic weapon is, in any event, believed known wherein adjustement in the degree of blowback delay, as to accomodate differently powered cartidges or "fine tune" the weapon action, may be readily and accurately effected without requiring internal disassembly of the weapon.

OBJECTS OF THE INVENTION

It is, accordingly, an object of my invention to provide a new and improved device for the controlled delay of blowback in high-powered automatic weapons.

Another object of my invention is the provision of a device as above which is of particularly simple and inexpensive design and construction in requiring few moving parts.

Another object of my invention is the provision of a device as above which, when applied to high-powered automatic pistols, enables the fixed mounting of the pistol barrel to the pistol receiver with attendant significant increase in pistol accuracy, strength, reliability of cartridge feeding and cartridge extraction; and attendant significant decrease in pistol complexity, cost and maintenance requirements.

Another object of my invention is the provision of a device as above which, when applied to high-powered automatic rifles, enables the elimination of the complex, expensive and maintenance-prone gas-operated cartridge feed and ejection mechanisms now currently in wide use to thus result in significant decrease in rifle cost and significant increase in rifle reliability.

A further object of my invention is the provision of a device as above which enables external adjustment in the degree of blowback delay to thus enable external "fine tuning" of the weapon.

DESCRIPTION OF THE DRAWINGS

The above and other objects and significant advantages of my invention are believed made clear by the following detailed description thereof taken in conjunction with the accompanying drawings wherein.

SUMMARY OF THE DISCLOSURE

As disclosed herein, the new and improved device of my invention for the controlled delay of blowback in high-powered automatic weapons basically comprises locking means which prevent opening of the weapon breech upon firing until such time as the bullet has left the barrel and the breech pressure has dropped to residual levels. For use in automatic pistols, the device comprises a hammerlock which initially locks the hammer to the slide while, for use in automatic rifles or submachine guns or the like, the device comprises a bolt lock which initially locks the bolt to the receiver. Ready and convenient adjustment in the point in time subsequent to cartridge ignition at which the locking device releases is made possible by adjustment in one or more of the operational characteristics of the device. Significant reductions in weapon cost and complexity, and significant increases in weapon reliability and, for pistols, accuracy are provided by the device.

DETAILED DESCRIPTION OF THE INVENTION

Figure 1:
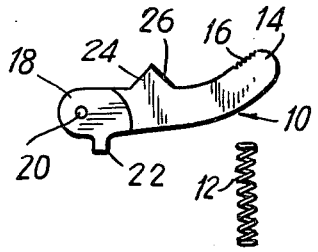
FIG. 1 is a side plan view of the device of my invention shown dis-assembled.
Figure 2:
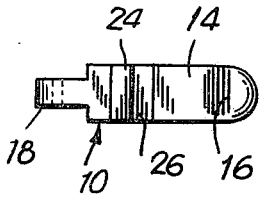
FIG. 2 is a top plan view of the device of FIG. 1.
Figure 3:
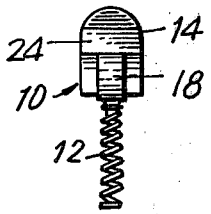
FIG. 3 is a front elevational view of the device of FIG. 1 shown assembled.

Referring now to FIGS. 1, 2 and 3 of the drawings, a new and improved device constructed and operative in accordance with the teachings of my invention may readily be seen to comprise a hammerlock as generally indicated at 10 and an operating, coil spring 12. The hammerlock 10 comprises a thumbpiece 14 extending therefrom as shown, with the upper rearward surface thereof preferably being knurled as indicated at 16 to facilitate grasping thereof for purposes described in detail hereinbelow. The forward portion 18 of the hammerlock 10 is of reduced thickness as best seen in FIG. 2, and includes a mounting aperture 20 extending therethrough as shown adjacent the generally rounded front end thereof. A spring-mounting stud is indicated at 22, and is, of course, configured to enable the mounting of the operating spring 12 thereover in the manner seen in FIG. 3.

Hammer locking means are indicated at 24 and take the form of a wedge which extends as shown from the upper surface of the hammerlock 10, and which includes an inclined hammer locking surface 26.

Figure 4:
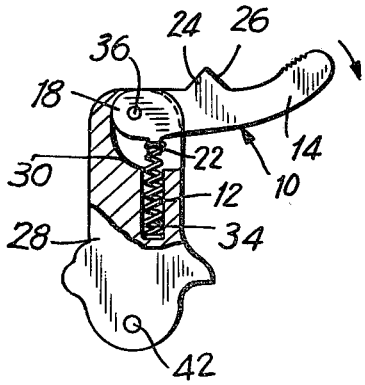
FIG. 4 is a side elevational view of the hammer of an automatic pistol incorporating the device of my invention therein and includes parts cut away and parts in cross section for purposes of illustration.
Figure 5:
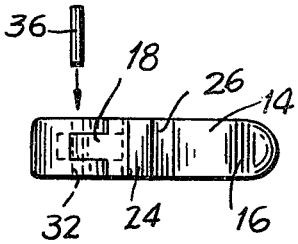
FIG. 5 is a top elevational view of the hammer of FIG. 4.

A representative hammer of an automatic pistol, as modified for use with the device of my invention, is indicated at 28 in FIGS. 4 and 5 and will readily be understood to comprise a cut-out or recess 30 formed in the upper rearward portion thereof to receive the hammerlock 10, a mounting aperture 32 formed as seen in FIG. 5 to extend transversely of the hammer 28, and an operating spring mounting bore 34 extending downwardly from recess 30 in the manner best seen in FIG. 4.

Mounting of the hammerlock 10 in the hammer 28 is accomplished by the disposition of the operating spring 12 in the mounting bore 34, the sliding of the forward portion 18 of the hammerlock into the hammer recess to engage stud 22 in the upper end of the operating spring 12 and to align the mounting apertures 20 and 32, and the insertion of an appropriately sized mounting pin 36 (FIG. 5) into the thusly aligned mounting apertures to pivotally secure the hammerlock to the hammer.

With the hammerlock 10 mounted as described in the hammer 28, it is believed clear that the former will be pivotally moveable about pin 36 as indicated in the clockwise direction, or downwardly against the biasing action of operating spring 12, with the force required for such movement being proportional, of course, to the operating spring force constant.

Figure 6:
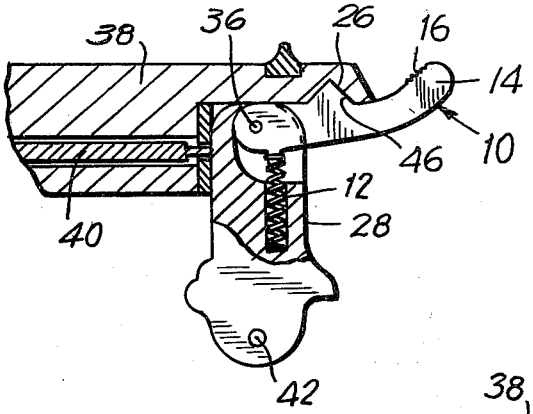
FIG. 6 is a side elevational view of the hammer of FIG. 4 depicted in operative relationship with portions of the slide and breech block of an automatic pistol with the hammer in the "down" position thereof, and the slide closed, and includes parts cut away and parts in cross section.
Figure 7:
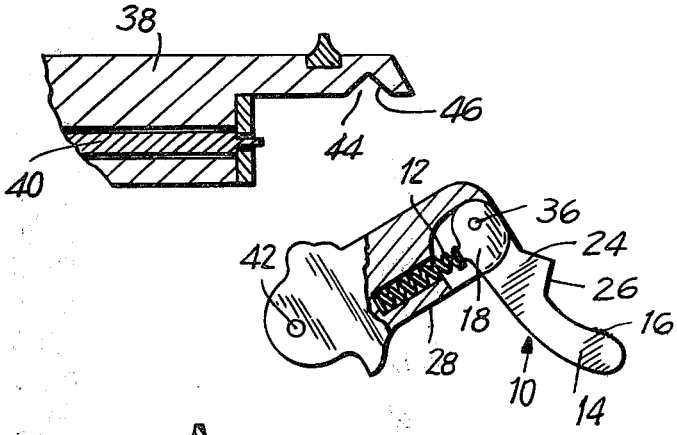
FIG. 7 is a view in the nature of FIG. 6 with the slide closed and the hammer "cocked;"

A representative application of the device of my invention to an automatic pistol is depicted in FIGS. 6 and 7 wherein the rear portion of the pistol slide is indicated at 38 and the pistol firing pin at 40; it being readily understood by those skilled in this art that the hammer 28 is, of course, pivotally mounted on the pistol receiver (not shown) by pin 42 for pivotal movement of the hammer between the "down" position thereof of FIG. 6 to the "cocked" position thereof of FIG. 7, and that the hammer 28 is retainable in the "cocked" position thereof, and forcefully pivotally moveable therefrom to the "down" position thereof to strike the firing pin for cartridge ignition upon the "pulling" of the pistol trigger, all by means of conventional trigger, stirrup, mainspring, hammer strut, disconnector and/or sear, or like components, which are believed too well known to require illustration and detailed description herein. Ready reference may, in any event, be made to *Small Arms Design And Ballistics* by T. Whelen as published by Small-Arms Technical Publishing Company of Georgetown, South Carolina in 1945 and/or *Automatic Pistols* by Capt. H. Pollard as published by Sir Isaac Pitman & Sons, Ltd. of Bath, Great Britain in 1920 for detailed description of the above.

Slide locking means are indicated at 44 and comprise a notch which is formed as shown in the rearward underside portion of the slide 38 to receive the hammerlock wedge 24. Notch 44 includes an inclined locking surface 46 which abuts the inclined locking surface 26 with the hammer 28 in the "down" position thereof of FIG. 6.

In operation, and assuming the hammer 28 to have just reached the "down" position thereof of FIG. 6 attendant the pulling of the trigger to fire a cartridge, it will be understood that the extremely high breech pressure immediately following cartridge ignition and probably peaking with the bullet one to two inches up the bore, will exert particularly substantial rearward force on the breech block and slide. This force will initially be mechanically resisted by the contact between the abutting locking surfaces 26 and 46 which, in essence, functions to temporarily mechanically lock the slide and hammer in the positions thereof of FIG. 6 and prevent rearward movement of the former; it being believed clear that the extent of this mechanical resistance will depend primarily upon the angle a (FIG. 8) of the locking surface 26 (with the greater the angle the greater the mechanical resistance), the force constant of the operating spring 12, and the area of surface contact, and accordingly extent of frictional force, between the abutting locking surfaces 26 and 46.

Figure 8:
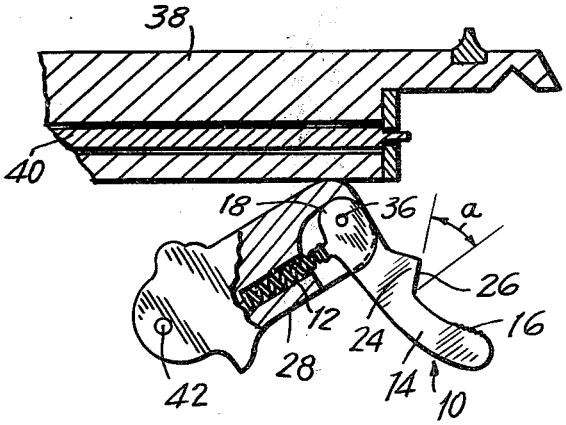
FIG. 8 is a view in the nature of FIG. 7 with the slide open.

At the point in time whereat the breech pressure-generated force exerted through the breech block by slide locking surface 46 on hammerlock locking surface 26, and the application time of that force, become sufficient to overcome the above-described mechanical resistance and pivotally move hammerlock 10 downwardly about pivot pin 36 against the bias of spring 12 (with desirable absorption of some of the recoil resulting from spring compression) to the extent that locking surface 26 is completely disengaged or "unlocked" from locking surface 46, it will be understood that conventional rearward movement of the breech block and slide, as now resisted only by the inertia thereof and mechanical resistance of the counter recoil spring, will commence, with hammer 28 and slide 38 soon reaching the positions thereof of FIG. 8. Thereupon, the slide will be returned in conventional manner to the closed position of FIG. 6 by the recoil spring with the hammer remaining in the "cocked" position thereof of FIG. 7 to complete a cartridge firing, ejection and new cartridge chambering cycle.

By the above is believed made clear that appropriate selection of the locking surface angle, the operating spring force constant, and the area of locking surface contact, will be effective to insure that the point in time at which the mechanical resistance of the hammerlock is overcome coincides with the point in time at which the bullet leaves the barrel and breech pressures have dropped to generally residual levels. Thus, intolerably dangerous premature opening of the breech is prevented; while "fine tuning" of the pistol as, for example, to adjust the same for optimal operation with a particular cartridge, is made possible by adjustment in one or more of the stated parameters, with replacement of the operating spring 12 by a spring of different force constant being, of course, the most readily accomplishable adjustment and requiring only the removal of pin 36 by way of pistol component disassembly.

Manual "cocking" of the hammer 28, and/or manual opening of the slide 38, will require only the initial depression of the hammerlock 10 as through the application of finger pressure on the knurled portion 16 of thumbpiece 14, to disengage locking wedge 26 from locking notch 44, whereupon the same may be readily accomplished in conventional manner.

With the incorporation as described of the hammerlock 10 of my invention in a high-powered automatic pistol, it will be clear that the same may be internally constructed and operable on the particularly simple, straight blowback principle in the manner, for example, of the Colt 0.25 calibre pocket automatic pistol. Thus, the barrel may be fixed to the receiver and the magazine may extend closer to the breech, all to result in a simpler, less expensive and more accurate and reliable weapon in full accordance with the stated objects of my invention.

Figure 9:
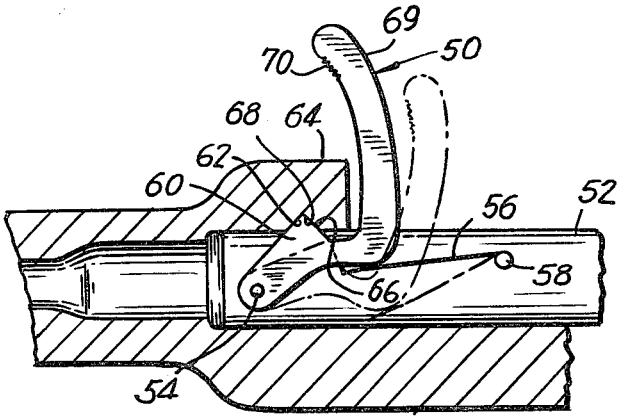
FIG. 9 is a top elevational view of a portion of the bolt and receiver of an automatic rifle or the like with the bolt closed and incorporating the device of my invention therein.

A representative application of the device of my invention to an automatic weapon which may, for example, take the form of an automatic rifle or submachine gun, is illustrated in FIG. 9; and will readily be seen therein to take the form of a boltlock 50 which is pivotally attached to the weapon bolt 52 by means of pin 54. The boltlock is biased toward the depicted position thereof by a flat operating spring 56 which is attached to the bolt 52 in any appropriate manner as indicated at 58.

A locking wedge 60 extends as shown from the boltlock 50 into a locking notch 62 formed in the receiver 64 to provide abutting locking surfaces 66 and 68, respectively. A handpiece 69 is formed on the boltlock 50 and again includes a knurled portion 70 to facilitate grasping thereof.

Operation of the boltlock 50 is substantially the same as that described hereinabove for the hammerlock 10; it being understood, however, that in this instance the receiver 64 remains stationary upon firing of the weapon with the bolt 52 being driven rearwardly by the gas pressure in the barrel resulting from cartridge ignition. Again, the bolt will remain locked to the receiver until the force exerted thereon by that gas pressure, nad the application time of that force, are sufficient to force locking surface 66 against the bias of spring 56 out of engagement with locking surface 68, whereupon the bolt 52 will be free to reciprocate in normal manner for fired cartridge case ejection and new cartridge chambering. Thus, internal operation of the weapon in accordance with the simple, direct blowback principles of operation is enabled with attendant elimination of the need for highly complex, costly and maintenance prone gas-operated mechanisms; it being again noted that some measure of desirable absorption of recoil will occure attendant the requisite compression of spring 56 for unlocking of the boltlock 50. In addition, use of a recoil spring of somewhat lower force constant in the weapon is made possible.

Various changes may, of course, be made in the disclosed embodiments of my invention without departing from the spirit and scope thereof as defined by the appended claims.

I claim:

1. In a device for the controlled delay of blowback in automatically operable weapons which include a barrel and which further include first and second parts which are relatively moveable upon firing of the weapon in response to breech pressures to open the weapon breech, the improvements comprising, locking means operatively associated with said relatively moveable parts, said locking means comprising abutting portions which are operable, when in abutment, to prevent relative movement of said first and second parts, said locking means portions being arranged to remain in abutment and delay breech opening until breech pressures have dropped to generally residual levels whereby, premature opening of the weapon breech is prevented, said locking means comprising a wedge operatively associated with the first of said parts, and a complementally shaped notch formed in the second of said parts, said wedge extending into said notch, said locking means portions comprising abutting surfaces of said wedge and notch, respectively, said weapon being an automatically operable pistol having an external hammer, said first and second parts respectively comprising the pistol hammer and the pistol slide.

2. In a device for the controlled delay of blowback in automatically operable weapons which include a barrel and which further include first and second parts which are relatively moveable upon firing of the weapon in response to breech pressures to open the weapon breech, the improvements comprising, locking means operatively associated with said relatively moveable parts, said locking means comprising abutting portions which are operable, when in abutment, to prevent relative movement of said first and second parts, said locking means portions being arranged to remain in abutment and delay breech opening until breech pressures have dropped to generally residual levels whereby, premature opening of the weapon breech is prevented, said locking means comprising a wedge operatively associated with the first of said parts, and a complementally shaped notch formed in the second of said parts, said wedge extending into said notch, said locking means portions comprising abutting surfaces of said wedge and notch, respectively said weapon being an automatically operable pistol having an external hammer, said first and second parts respectively comprising the pistol hammer and the pistol slide, and said locking means further comprising a hammerlock pivotally mounted on said hammer and including said wedge, said hammerlock being pivotally moveable on said hammer between a first hammerlock position wherein said wedge extends into said notch, and a second hammerlock position wherein said wedge does not extend into said notch.

3. In a device as in claim 2 further comprising, a spring operatively associated with said hammer and hammerlock and operable to bias the latter into said first hammerlock position.

* * * * *